US006862912B2

(12) United States Patent
Olsson

(10) Patent No.: US 6,862,912 B2
(45) Date of Patent: Mar. 8, 2005

(54) IMPACT MACHINE

(75) Inventor: Håkan Olsson, Karlskoga (SE)

(73) Assignee: Morphic Technologies Aktiebolag (publ), Karlskoga (SE)

( * ) Notice: Subject to any disclaimer, the term of this patent is extended or adjusted under 35 U.S.C. 154(b) by 0 days.

(21) Appl. No.: 10/433,699

(22) PCT Filed: Nov. 16, 2001

(86) PCT No.: PCT/SE01/02545

§ 371 (c)(1),
(2), (4) Date: Jun. 5, 2003

(87) PCT Pub. No.: WO02/47844

PCT Pub. Date: Jun. 20, 2002

(65) Prior Publication Data

US 2004/0040364 A1 Mar. 4, 2004

(30) Foreign Application Priority Data

Dec. 11, 2000 (SE) ..... 0004553

(51) Int. Cl.[7] ..... B21J 7/34; B21J 13/03
(52) U.S. Cl. ..... 72/355.6; 72/407
(58) Field of Search ..... 72/407, 360, 355.6; 425/352, 356

(56) References Cited

U.S. PATENT DOCUMENTS 2,135,803 A * 11/1938 Dumert ..... 419/66
3,271,991 A * 9/1966 Monahan ..... 72/407
4,069,700 A * 1/1978 Bocharov et al. ..... 72/407
4,191,044 A * 3/1980 Grigorenko et al. ..... 72/355.6
4,739,644 A 4/1988 Maki et al. ..... 72/359
5,715,724 A 2/1998 Crout et al. ..... 72/438
5,746,085 A * 5/1998 Harada et al. ..... 72/355.6
6,250,128 B1 * 6/2001 Ando et al. ..... 72/355.6
6,698,267 B1 * 3/2004 Olsson ..... 72/355.6

FOREIGN PATENT DOCUMENTS

EP 0 560 010 9/1993

OTHER PUBLICATIONS

WPI/Derwent Abstract Accession No. 1997–113741, week199711, Abstract of JP, 9001274 A (Toyota Jidosha KK), Jan. 7, 1997 (Jan. 7, 1997); Figure 1.
WPI/Derwent abstract Accession No. 1999–425309, week199936, Abstract of JP 11172304 A (Aishin Keikinzoku KK), Jun. 29, 1999 (Jun. 29, 1999); Figure 1.
WPI/Derwent abstract Accession No. 2000–231910, week200020, Abstract of JP 2000051989 A, (Hoei Kogyo KK), Feb. 22, 2000 (Feb. 22, 2000); Figure 1.

* cited by examiner

*Primary Examiner*—Daniel C. Crane
(74) *Attorney, Agent, or Firm*—Michael D. Bednarek; Shaw Pittman LLP

(57) ABSTRACT

The invention concerns an impact machine for forming, cutting, or punching a working material in a mould die by impact action during an impact operation carried out by means of impact devices, preferably from two opposite directions, said impact devices being provided to strike the working material or impact members which transfer the impact energy of the impact devices to the working material, said die (9) being carried by a carrier (2) included in the impact machine. According to the invention, the die is resiliently mounted in the carrier, which e.g. may consist of a stationary or moveable table.

6 Claims, 3 Drawing Sheets

IMPACT MACHINE

TECHNICAL FIELD

The present invention relates to an impact machine for forming, cutting, or punching a working material in a mould die by impact action during an impact operation carried out by means of impact devices, preferably from two opposite directions, said impact devices being provided to strike the working material or impact members which transfer the impact energy of the impact devices to the working material, said die being carried by a carrier included in the impact machine. The invention also relates to said carrier and how the die i mounted in the carrier.

BACKGROUND OF THE INVENTION

If the impact devices of an impact machine of the above mentioned type, where the impact devices move towards the working material from two opposite directions, simultaneously hit the working material or members which transfer the kinetic energy of the impact device to the working material, and if the moveable impact devices which move towards one another, have equally large momentums, e.g. equally large masses and equally large velocities, and if the friction forces which arise in the die during the forming operation, are equally large in all parts of the die, etc., no forces will be transferred from the stroke to the carrier and from the carrier to a machine stand, foundation, etc. But in the art of technology, there do not exist any absolute synchronism, no masses which are exactly equally large, no momentums which are exactly equally large, no exactly equal friction conditions of various surfaces, etc. Therefore some unavoidable forces will be generated in connection with impact machines of the above-mentioned type, which forces may be transferred from the die to its environment, if that is not prevented in some way. Such forces may be negligible, if there is a very far going synchronism of the movements of the various, moveable parts, if the momentums are nearly equal, etc., but sometimes they can not be neglected, e.g. if a number of various error sources are added to one another. Therefore it has been suggested in the Swedish patent application 0002030-5 of the same applicant as of the present application, to make the carrier spring-mounted, so that any forces or chock-like stresses are not transferred to the stand and foundation. However, the carrier and the die or dies which are provided in the carrier, have a considerable mass. Because of the inertia of this mass, it is difficult to prevent, by means of resilient connections between carrier and machine stand, that harmful forces are developed in the carrier and possibly transferred to the stand.

DISCLOSURE OF THE INVENTION

It is the purpose of the present invention to address the above complex of problems. It is a characteristic feature of the invention that the die is resiliently provided in the carrier.

It is a characteristic feature of a preferred embodiment that the die is provided in a through hole in the carrier and that at least a first intermediate member is provided between the carrier and the die, which intermediate member may be annular and be resiliently connected to the carrier and to the die, either directly or via additional intermediate members.

The carrier, in which the die or the dies is/are provided, may consist of at stationary or moveable table, which can be described as a working table, the upper surface of which is utilized in connection with the filling of the die with a working material, as is described in the Swedish patent application 0002030-5. In order that the table shall be able to fulfil this task, it is important that its upper side is flat. This makes it more difficult to make the die resilient. In order to improve this possibility it is particularly important, according to an aspect of the invention, that at least a first intermediate member is provided between the carrier and the die, and that said member has an upper side which also is flat and which in its normal position is on a level with the flat upper sides of the table and of the tool unit.

Further characteristic features and aspects of the invention will be apparent form the appending patent claims and from the following description of a preferred embodiment.

BRIEF DESCRIPTION OF DRAWINGS

In the following description of a preferred embodiment, reference will be made to the accompanying drawings, in which.

DETAILED DESCRIPTION OF A PREFERRED EMBODIMENT

Figure 1:
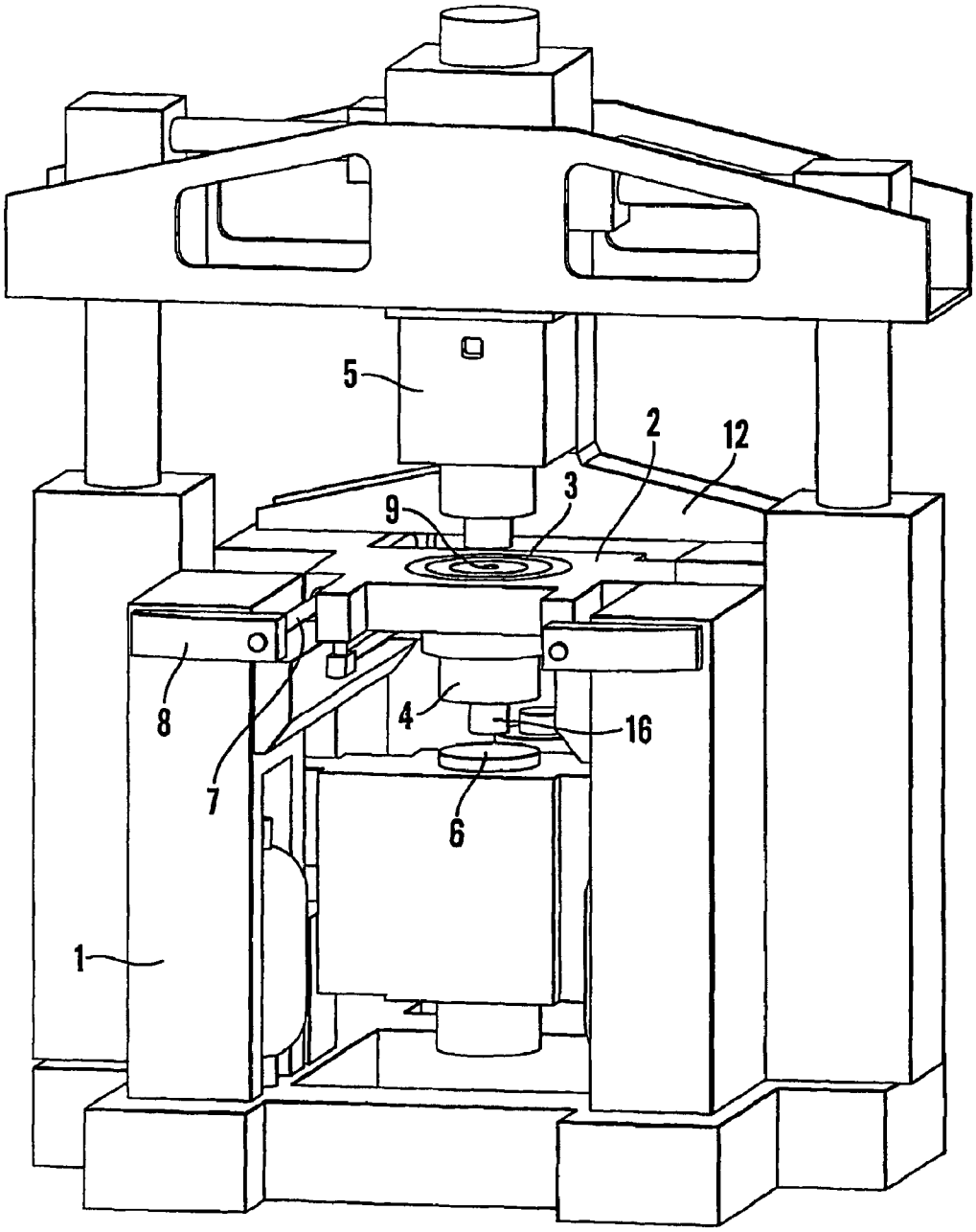
FIG. 1 is a perspective view of an impact machine, in which the invention has been implemented.

In FIG. 1 there is shown a so called impact machine. This is a machine for working by employing a high kinetic energy for in the first place metal working, such as cutting an punching, forming of metals, powder compaction and similar operations. In the described example it is conceived that the machine shall be used for compacting metal powders.

The machine comprises a stand 1 and a tool carrier 2, which carries a tool unit 3. The tool unit 3 comprises a die 9 and a lower punch 16 having a lower punch holder 4 and a lower punch holder guide 17, provided under the die. The working principle of the machine is the development of a very high kinetic energy of short duration of an upper ram 5 and of a lower ram 6, which simultaneously are stricken form above and from below, respectively, against an upper punch 18 and against the lower punch 16 in the tool unit 3 and against the working material 11 which is placed in the mould cavity 10, FIG. 2, of the tool die, said working material consisting of a metal powder according to the example.

The upper punch 18 and the lower punch 16 are tubular according to the embodiment for the manufacturing of annular products. A mandrel 50 extends through the lower punch 16 which has a head 16*a* an its lower end. The lower punch 16 is connected to the lower punch holder 4 by means of a plate 4*a*, which is secured by screws to the lower punch 4, and which secures the head 16*a* and hence the lower punch 16 to the lower punch holder 4. The mandrel 50 similarly has a head 50*a* at its lower end, recessed in a central through boring having a corresponding shape in the punch head 16*a*, wherein the mandrel 50 gets a defined upper position, when the lower punch 16 is in its lower position. The mandrel 50 is pressed upwards to its said upper position by means of a compression spring 51 in a central boring 52 in the lower punch holder 4.

The tool carrier 2 consists of a table, more particularly of a table which like a shuttle is moveable between two working stations; a forming station and a preparation station.

The preparation station is more at the rear as viewed by the viewer. In the preparation station the formed product is ejected out of the tool, the lower punch is returned to its starting position, and the mould cavity 10 of the die 9 is filled with new working material 11. During the movement between the working stations, the table 2 slides on a pair of horizontal guides 7, which are mechanically rigidly connected to the machine stand 1 via arms 8. As a holder-up at the ejection operation a yoke 12 is provided in the preparations station, which yoke extends above a table 2 quite near its upper surface 13, which is horizontal and flat, on a level with the flat upper surface of the tool unit 3. A mounting ring 14 also is included in the tool unit 3, which ring clamps the die 3 to the lower punch holder guide 17 by means of screws 15. The die 3, the mounting ring 14, the lower punch holder 4 with the lower punch 16, the lower punch holder guide 17, and the mandrel 50 together form the integrated tool unit 3, which has a flat upper surface, including also the mandrel 50, on a level with the flat upper surface 13 of the table 2.

The upper, tubular punch 18, is coaxial with the lower punch 16. An upper punch holder is designated 19. Prior to the stroke, the upper punch 18 is slightly lowered into the mould cavity 10.

The mounting ring 14 has an outer, conical surface 23, which slopes downwards-outwards. The outer side surfaces are circular symmetric.

The integrated tool unit 3 is mounted in a through opening 20 in the table 2. In said opening, between the integrated tool unit 3 and the table 2, more exactly between the mounting ring 14 and the table 2, there is also an intermediate ring 26 having a flat upper surface 27 and a flat bottom surface, which rests against a flat annular surface of a mounting plate 35, which is fixed to the table 2 by means of screws 28. The intermediate ring 26 has a conical, inner surface 53 abutting against and matching the conical surface 23 of the mounting ring 14, as well as conical surface 54 sloping inwards-downwards and abutting against and matching a corresponding inwardly-downwardly sloping surface 55 of the mounting plate 35.

The mounting ring 14 has a cylindrical, annular recess 30 on its outer side facing the intermediate ring 26, which recess is defined downwards by the upper surface of the mounting plate 35 in that part of the mounting plate 35 which abuts the mounting ring 14.

In a corresponding manner, there is a cylindrical, annular recess 31 in the lower corner of the through opening 20 in the table 2.

In the first mentioned, cylindrical recess 30 there is a first resilient ring 41, and in the second cylindrical recess 31 there is a second resilient ring 42. The resilient rings 41 and 42, which are somewhat biased, entirely fill their respective recess 30 and 31 in the vertical direction. On the other hand, the rings do not entirely fill the respective recesses 30, 31 in the lateral direction, which implies that the rings may be compressed in the axial direction and thus spring laterally.

Said conical surfaces 23, 53 and 54, 55, respectively, centre the tool unit 3, so that it gets entirely coaxial to the upper punch 18. This is performed initially at the mounting of the tool unit 3, which is then given a final flat grinding, so that all parts included in the tool unit 3 get flat upper surfaces, including the upper surface of the mandrel 50, quite on a level with the upper surface of the table/shuttle 2. This is of essential importance for making it possible to fill the mould cavity 10 with powder 11 during a filling operation by means of a filling bucket sliding against the table 2 and against the upper surface of the tool unit 3.

For the function of the tool unit 3 it is also important that the spring 41, which aims at pressing the die 9 and the mounting ring 14 upwards, and the spring 42, which aims at pressing the die 9, the mounting ring 14 and the intermediate ring 26 downwards, lie on each side of the intermediate ring 26. This contributes to bringing the die, as well as the mandrel 50 and the mounting ring 14 on a level with the table 2 and with the intermediate ring 26. On the other hand, the intermediate ring 26 and the die 9 and the mounting ring 14 can move upwards relative to the table 2 by compression of the outer spring 42, and the die 9 with the mandrel 50 and the mounting ring 14 can move downwards relative to the intermediate ring 26 and the table 2 by compression of the inner spring 41. When everything is in resting position and the rings 41 and 42 have expanded and are biased, all said upper surface are on a level with on another.

The springs 41 and 42 are suitably made as rings of polyurethane or possibly any other resilient polymer. Also mechanical springs are in principle conceivable, but polyurethane is a preferred spring material.

The thus described impact machine and the table 2 with tool unit 3, which is resiliently mounted function in the following way.

In the preparation station the mandrel 50 is by means of a not shown mandrel pusher driven so far down into the boring 52 in the lower punch holder 4 during compression of the spring 51, that the mandrel is entirely released from the compacted body, which has been formed in a foregoing forming operation. Then said body is ejected out from below by means of the lower punch 16. For the ejection there can in some cases be required a great power, which is transferred via the die 9 and the mounting ring 14 to the intermediate ring 26, so that the tool unit 3 and the intermediate ring 26 are pressed upwards causing the outer, resilient polyurethane ring 42 to be compressed until the tool unit 3 and/or the intermediate ring 26 abuts the yoke 12, which occurs before the resilient ring 42 has been maximally compressed. This implies that the guides 7 are not subjected to any overloading during the ejection operation.

Figure 2:
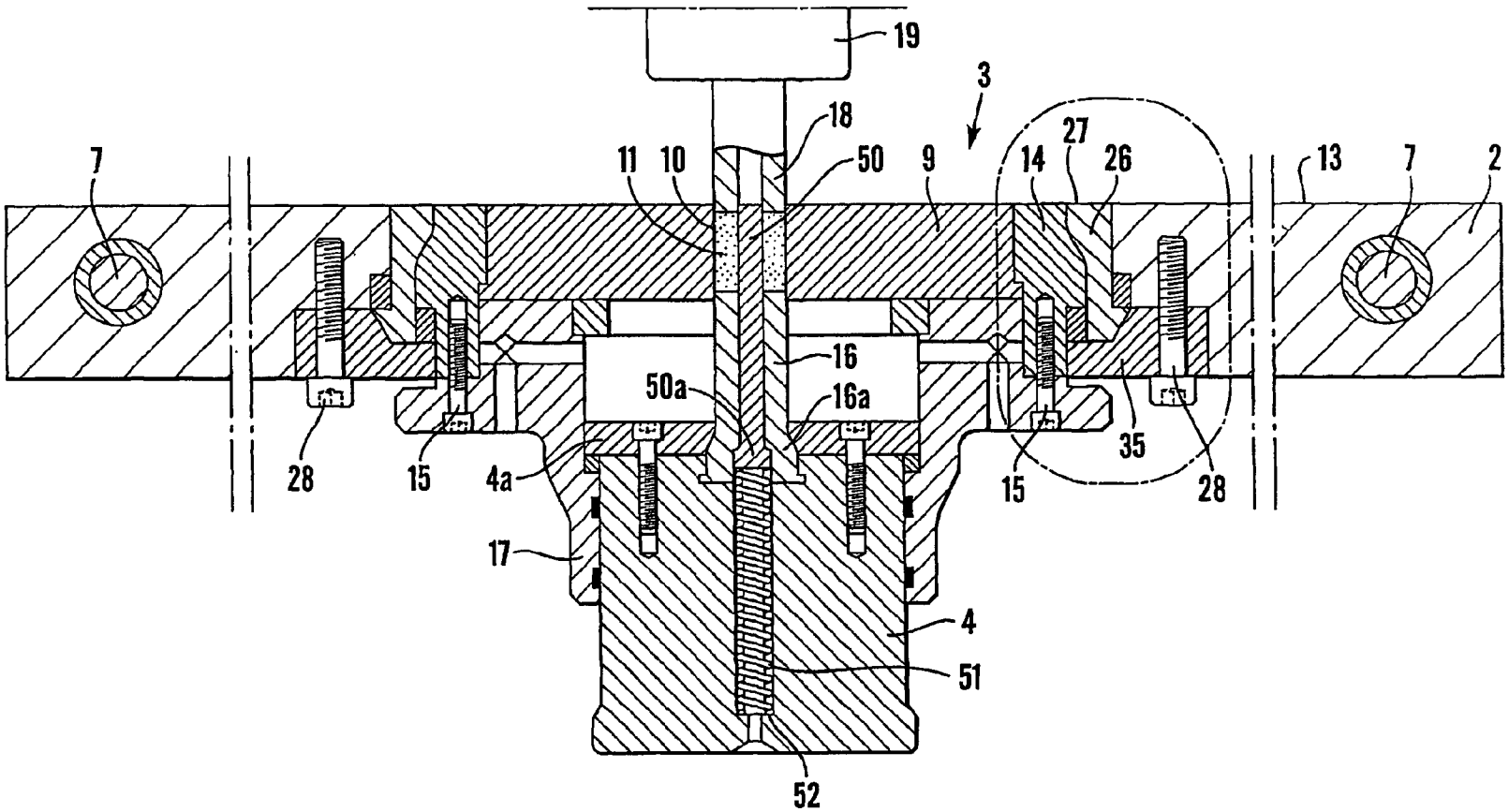
FIG. 2 shows an axial section through the tool unit, comprising a die which is resiliently mounted in a carrier, and punches cooperating with the die.
Figure 2A:
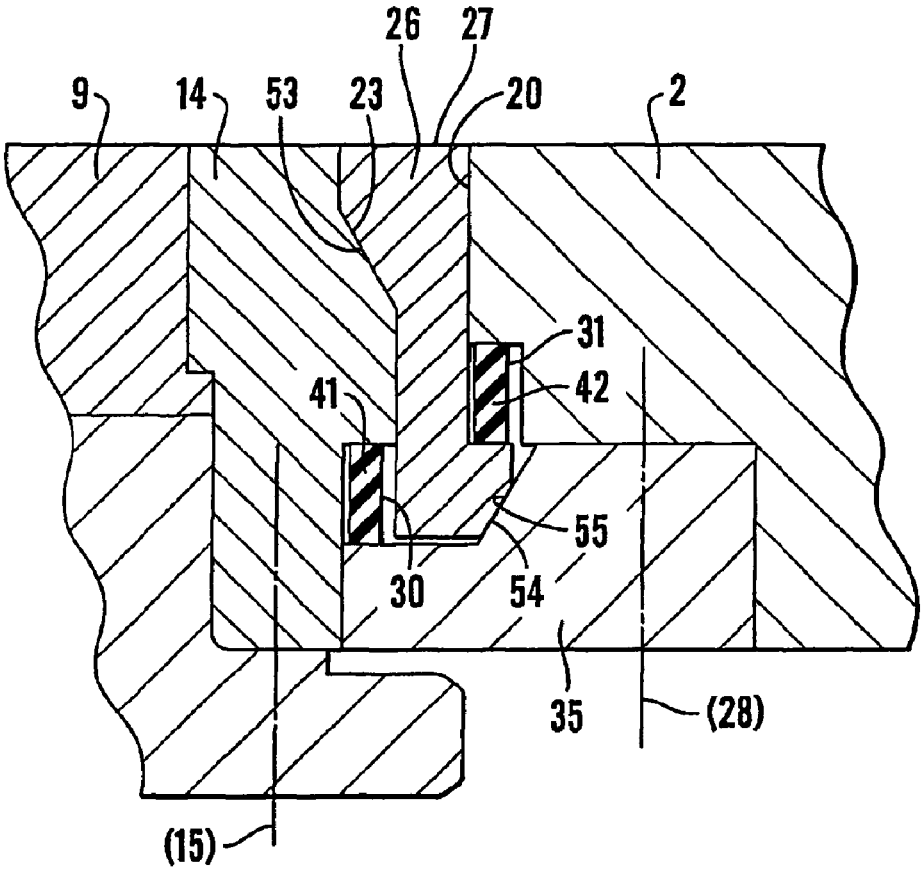
FIG. 2A shows an encircled portion of FIG. 2 on a larger scale.

When the formed product thus has been ejected out from the mould cavity 10 in the preparation station, the lower punch 16 is withdrawn to its starting position shown in FIG. 2. At the latest in connection herewith, the tool unit 3 springs back to its starting position, i.e. so that the upper surfaces of the tool unit 3, the intermediate ring 26 and the table 2 again will line on a level with one another, which is guaranteed through the springing back action of the outer resilient ring 42. When this has occurred, the forming cavity 10 is filled with metal powder 11, which can simply be performed by means of a filling bucket, which can consist of just a vertical, metal powder filled tube, which rests against the upper surface of the table 2. During the filling operation, the metal filled tube (filling bucket) is caused to slide against the upper surfaces of the table 2, the intermediate ring 26 and the upper surface of the table 3, which is possible because these details have flat and even upper surfaces, which are on a level with one another and do not have any parts which project to form any hindrance in the path of the filling bucket. Thus, the filling bucket is moved to the area of the mould cavity 10, which is filled with the powder 11 and then is moved back; also this time sliding against the tool unit, the intermediate ring and the table top.

The table 2, sliding on the guides 7, now is moved to the forming station, FIG. 1 and FIG. 2. In the forming station the upper punch 18 is lowered a distance into the mould cavity 10, so that the powder 11 is slightly compacted, the lower punch 16 functioning as holding-up tool. During the forming operation, the upper and lower rams 5, 6 strike simultaneously at a high velocity against the upper punch holder 19 and against the lower punch holder 4, respectively. The conceptions simultaneously and synchronously, however, are relative conceptions, which has been mentioned in the description of the background of the invention. In practice, on of the rams will hit its punch somewhat before the other ram. In consideration of the high velocities, the time difference can not always be neglected. As the punches 18 and 16 successively move into the mould cavity 10, compressing the metal powder 11 between them, also the resistance of the powder successively is increased. Also, friction between the power and the wall of the mould cavity 10 arises. Neither the resistance of the powder against the respective punch, nor the friction which the powder exerts against the die 9 in the upper and in the lower part of the mould cavity respectively, is necessarily uniform. As a matter of fact one has in practise to count on a certain degree of non-uniformity. All this implies that a resulting vertical, axial force normally acts on the die during the impact operation. This can be either upwards directed or downwards directed. In the former case, the vertical force is essentially absorbed by the outer, resilient polyurethane ring 42. In the latter case, the force is essentially absorbed by the inner, resilient polyurethane ring 41. The capacity of the resilient rings 41, 42 to absorb the vertical forces in other word implies an efficient dampening of the force pulse of short duration which can arise. To the extent that the force pulse nevertheless is transferred to the table 2, such a pulse will be further dampened by the table due to its considerable mass, so that the stresses which may be transformed from the die 9 to the guides 7 and to the machine stand 1 will be so small that they do not damage the machine or its included parts. Air existing in the space between the lower punch holder 4*a* and the die 9 is pressed out at the impact through expansion channels provided in the lower punch holder guide 17.

It shall be understood that the invention can be completed and modified within the scope of the appending patent claims. Thus, e.g. the intermediate ring 26 can be designed in many other ways than has been shown in the example. For example flanges and recesses can be placed on the other way round, e.g. be reversed, with the maintenance of the principle that two different resilient elements or sets of resilient elements are provided, one outer one on the outside of the intermediate ring and an inner one on the inside of the intermediate ring while one of theses resilient elements or sets of resilient elements are provided to absorb downwards directed forces and the other of the resilient elements or sets thereof are provided to damp upwards directed forces acting under the tool unit.

Among modifications there might also be mentioned that the resilient elements not necessarily need to consist of elastic rings. Also metallic spring elements of various kinds e.g. helical springs provided in the spaces 30 and 31 are conceivable. Further, it should also be conceived that the invention does not necessarily require separate rams to be used at the forming operation. Instead, impact devices in the form of hydraulic pistons may be used, in which case the piston rods of the hydraulic pistons are connected to the upper punch and to the lower punch, respectively, so that the punches with their united piston rods and impact pistons form an upper and a lower, respectively, integrated unit.

What is claimed is:

1. Impact machine for forming, cutting, or punching a working material in a mould die by impact action during an impact operation carried out by means of impact devices from two opposite directions, said impact devices being provided to strike the working material or impact members which transfer the impact energy of the impact devices to the working material, said die (9) being carried by a carrier (2) included in the impact machine, characterized in that said impact devices are provided to hit the working material or impact members which transfer the kinetic energy of the impact devices to the working material from two opposite directions essentially simultaneously, and that the die (9) is resiliently mounted in the carrier (2) and at least an inner resilient element (41), or set of resilient elements, is provided between an intermediate member and the die, that an outer resilient element (42), or set of resilient elements, is provided between the intermediate member and the carrier, and that one of said inner and outer resilient elements is provided to damp downwards directed forces acting on the die, while the other of said first and second resilient elements is provided to damp upwards directed forces acting on the die.

2. Impact machine according to claim 1, characterized in that between the carrier (2) and the die (9) there is at least the intermediate member (26) which directly or via any further intermediate member is resiliently connected to the carrier (2) and to the die (9).

3. Impact machine according to claim 2, characterized in that the die (9) is provided in a through opening (20) in the carrier and that said first intermediate member defining an intermediate ring (26) is provided in said hole between the die and the carrier.

4. Impact machine according to claim 1, characterized in that said inner resilient element is provided to act upwards on the a tool unit which comprises the die (9), and that said outer resilient element (42) is provided to act in a direction downwards on said intermediate member relative to the carrier (2).

5. Impact machine for forming, cutting, or punching a working material in a mould die by impact action during an impact operation carried out by means of impact devices from two opposite directions, said impact devices being provided to strike the working material or impact members which transfer the impact energy of the impact devices to the working material, said die (9) being carried by a carrier (2) included in the impact machine, characterized in that said impact devices are provided to hit the working material or impact members which transfer the kinetic energy of the impact devices to the working material from two opposite directions essentially simultaneously, and that the die (9) is resiliently mounted in the carrier (2), between the carrier (2) and the die (9) there is at least a first intermediate member (26) which directly or via any further intermediate member is resiliently connected to the carrier (2) and to the die (9), the die (9) is provided in a through opening (20) in the carrier and that said first intermediate member defining an intermediate ring (26) is provided in said hole between the die and the carrier, and the inner side of the intermediate ring has a first conical surface (23) and its outer side has a second conical surface (54), that the die, or a ring (14) which is stationary connected to the die, has a third conical surface (53) which abuts and matches the first conical surface, and that a table, or a member (35) which is stationarily connected to the table, has a fourth conical surface (55) which abuts and matches the second conical surface, for the purpose of centering the die in the opening in the carrier.

6. Impact machine according to claim 5, characterized in that said first and third conical surfaces slope downwards-outwards and said second and fourth conical surfaces slope downwards-inwards.

* * * * *